US006625854B1

(12) United States Patent
Sudol et al.

(10) Patent No.: US 6,625,854 B1
(45) Date of Patent: Sep. 30, 2003

(54) ULTRASONIC TRANSDUCER BACKING ASSEMBLY AND METHODS FOR MAKING SAME

(75) Inventors: Wojtek Sudol, North Andover, MA (US); Francis E. Gurrie, North Andover, MA (US); Rodney J. Solomon, Andover, MA (US); Alec Rooney, Eliot, ME (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/448,527

(22) Filed: Nov. 23, 1999

(51) Int. Cl.[7] ..... H04R 17/00

(52) U.S. Cl. ..... 29/25.35; 29/609.1; 29/594; 29/830; 29/831; 310/3

(58) Field of Search ..... 29/25.35, 594, 29/609.1, 832, 830; 310/334, 326

(56) References Cited

U.S. PATENT DOCUMENTS 3,851,300 A * 11/1974 Cook ..... 340/8 R
4,604,543 A * 8/1986 Umemura ..... 310/334
5,115,809 A * 5/1992 Saitoh ..... 128/662.03
5,267,221 A 11/1993 Miller David G. et al. . 367/140
5,329,498 A 7/1994 Greenstein ..... 367/155
5,559,388 A * 9/1996 Lorraine ..... 310/334
5,566,132 A * 10/1996 Janus ..... 367/163
5,592,730 A * 1/1997 Greenstein ..... 29/594
5,629,906 A 5/1997 Sudol et al. ..... 367/162
5,648,941 A 7/1997 King ..... 367/176
5,852,860 A * 12/1998 Lorraine ..... 29/25.35
5,938,612 A * 8/1999 Kline-Schoder ..... 600/459
6,088,894 A * 7/2000 Oakley ..... 29/25.35

* cited by examiner

*Primary Examiner*—Carl J. Arbes
*Assistant Examiner*—Tai Nguyen
(74) *Attorney, Agent, or Firm*—John Vodopia

(57) ABSTRACT

An acoustic backing element includes a glass fiber epoxy composite planar substrate to the outer major surfaces of which are applied electrically conductive material. The electrically conductive material may be a conductive layer that is etched to expose electrical contact material in the form of conductive traces. Each conductive trace provides electrical connection between a transducer element and electrical control circuitry typically located on an electrical circuit board. The acoustic backing element provides precisely located electrical contacts for connecting the transducer elements to their control circuitry, while simultaneously providing superior acoustic attenuation. In addition, the thermal coefficient of expansion (TCE) of the glass fiber epoxy composite material comprising the planar substrate can be closely matched to the TCE of the electrical contact material. In this manner, fatigue and failure caused by mechanical stresses between the planar substrate and the electrical contact material due to temperature extremes and temperature cycling are significantly reduced.

35 Claims, 10 Drawing Sheets

ULTRASONIC TRANSDUCER BACKING ASSEMBLY AND METHODS FOR MAKING SAME

TECHNICAL FIELD

The present invention relates generally to ultrasonic transducers, and, more particularly, to an ultrasonic transducer backing assembly constructed using a composite acoustic absorption material and a method for making same.

BACKGROUND OF THE INVENTION

Ultrasonic transducers have been available for quite some time and are useful for interrogating solids, liquids and gasses. One particular use for ultrasonic transducers has been in the area of medical imaging. Ultrasonic transducers are typically formed of piezoelectric elements. The elements typically are made of material such as lead zirconate titanate (abbreviated as PZT), with a plurality of elements being arranged to form a transducer assembly. Alternatively, ultrasonic transducer elements may be fabricated using semiconductor manufacturing technology in combination with micro-machining technology to fabricate a micro-machined ultrasonic transducer (MUT) on a semiconductor substrate. Such a MUT is described in U.S. Pat. No. 5,619,476 to Haller, et al., the disclosure of which is hereby incorporated into this document by reference.

The MUT's are formed using known semiconductor manufacturing techniques resulting in a capacitive non-linear ultrasonic transducer that comprises, in essence, a flexible membrane supported around its edges over a substrate, which may be a semiconductor substrate. By applying electrical contact material to the membrane, or a portion of the membrane, and to the substrate, and by applying appropriate voltage signals to the contacts, the MUT may be energized such that an appropriate ultrasonic wave is produced. Similarly, the membrane of the MUT may be used to receive ultrasonic signals by capturing reflected ultrasonic energy and transforming that energy into movement of the membrane, which then generates a receive signal. When imaging the human body, the membrane of the MUT moves freely with the imaging medium, thus eliminating the need for acoustic matching layers.

The transducer assembly (whether PZT or MUT) is then assembled into a housing possibly including control electronics, in the form of electronic circuit boards, the combination of which forms an ultrasonic probe. This ultrasonic probe, which may include acoustic matching layers between the surface of the transducer element or elements and the probe body, may then be used to send and receive ultrasonic signals through body tissue.

Ultrasonic transducers typically operate by delivering acoustic energy to a target to be interrogated and receiving a version of the emitted pulse back as acoustic energy, which has been modified by the target and includes imaging information regarding the target. The received acoustic energy is then converted by the transducer to an electrical signal and processed by electronics to display an image of the interrogated target on a display.

When an electrical pulse excites a transducer element, the transducer emits acoustic energy from both a front surface and a rear surface. The acoustic energy emitted from a front surface is usually directed toward the target that is being interrogated. The acoustic energy emitted from the rear surface, however, may cause difficulties with the signal that is received from the target. This interference happens when acoustic energy directed from the rear surface of the transducer interferes with acoustic energy received from the target that is under interrogation. The acoustical energy that is directed from the rear of the transducer may create acoustic oscillations, thus causing interference with the acoustic energy received from the target.

Furthermore, a potential drawback of ultrasonic transducers is that some of the acoustic energy generated during a transmit pulse, and some of the acoustic energy received during a receive pulse, is transferred into the substrate on which the transducer is formed. This acoustic energy transferred to the substrate may be in the form of "Lamb waves", or other acoustic waves, that may interfere with the operation of the transducer. Lamb waves are waves of acoustic energy that travel through a thin plate of material parallel to its surfaces, and in this instance may be said to travel parallel to a surface of the substrate. Furthermore, a portion of this acoustic energy may be coupled back into the transducer's active area, thus causing significant interference with the operation of the transducer.

To minimize the detrimental effects of the aforementioned acoustic interference, transducer assemblies typically include backing material. The backing material performs a number of functions. First, the backing material may provide a mechanical support for the transducer or the transducer array, as transducers are typically formed in arrays including a number of individual transducer elements. The backing material may also provide for attenuation, or absorption, of the acoustic energy emitted from the rear surface of the transducer, thus minimizing the above-described acoustical interference. The backing material is typically constructed of a material that includes electrical contact material.

Typically, the electrical contact material is formed in, or added to, the backing material to provide an electrical connection through which an excitation pulse may be communicated from control circuitry to the transducer element and through which a receive pulse may be communicated form the transducer element to the control circuitry.

A drawback of this backing material is that the electrical contacts formed therethrough, or included therein, are difficult to precisely locate within the backing material such that they provide proper connection between the transducer elements and the control circuitry without the electrical contacts coming in contact with each other. This is a significant drawback when lead spacing uses fine pitch (where electrical contacts are spaced on the order of 250 microns or less) technology. Another drawback of this backing material is that the thermal coefficient of expansion of the backing material is frequently different than that of the electrical conductors associated therewith. Furthermore, the TCE of the backing material is also frequently different than that of the control circuitry and of the transducer elements that the backing material is located between. Unfortunately, this undesirable condition leads to failures in the electrical connections between the backing material and the control circuitry and leads to failures in the electrical connections between the backing material and the transducer elements.

Therefore, it would be desirable to have a backing material that can effectively reduce or eliminate the acoustic energy projected from the rear of a transducer. It would be desirable for this backing material to have a thermal coefficient of expansion that closely matches that of the electrical contact material used to connect a transducer to control circuitry and that reduces fabrication difficulties.

SUMMARY OF THE INVENTION

The invention provides a backing for an ultrasonic transducer, comprising a first planar substrate including a first surface. The first planar substrate is configured to acoustically couple to the ultrasonic transducer. Electrical contact material applied to the first surface of the first planar substrate is configured to electrically couple to the ultrasonic transducer.

The present invention may also be conceptualized as a method for making a backing for an ultrasonic transducer, comprising the following steps: forming a first planar substrate to include a first surface and configured to acoustically couple to the ultrasonic transducer; and applying an electrical contact material to the first surface. The electrical contact material is configured to electrically couple to the ultrasonic transducer.

BRIEF DESCRIPTION OF THE DRAWINGS

The present invention, as defined in the claims, can be better understood with reference to the following drawings. The components within the drawings are not necessarily to scale relative to each other, emphasis instead being placed upon clearly illustrating the principles of the present invention.

DETAILED DESCRIPTION OF THE PREFERRED EMBODIMENT

While the invention will be described with particular reference to PZT transducer elements, the invention is equally applicable to any transducer element or array. For example, the invention is equally applicable to micro-machined ultrasonic transducer (MUT) elements. Furthermore, the concepts of the invention are applicable to ultrasonic transducers in both transmit mode and receive mode.

Figures 1A, 1B, 1C:
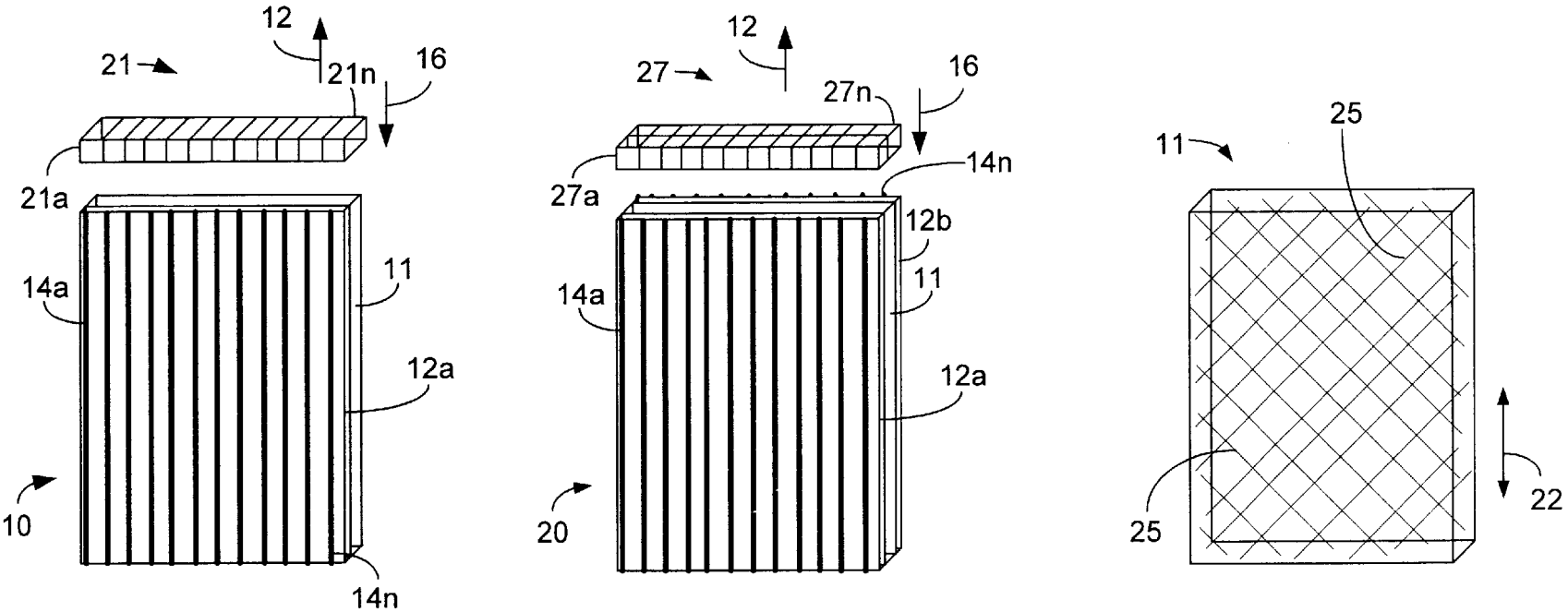
FIG. 1A is a schematic view illustrating backing assembly element constructed in accordance with the invention.
FIG. 1B is schematic view illustrating an alternative embodiment of the backing assembly element of FIG. 1A.
FIG. 1C is a schematic view illustrating the planar substrate of FIGS. 1A and 1C.

Turning now to the drawings, FIG. 1A is schematic view illustrating a backing assembly element 10 constructed in accordance with the invention. Backing assembly element 10 includes a first planar substrate 11 having a major surface to which a conductive layer 12*a* is applied. In an alternative embodiment to be discussed below with respect to FIG. 1B, first planar substrate 11 may have conductive layers 12*a* and 12*b* applied to both major surfaces thereof First planar substrate 11 can be any "sheet formed" material such as, but not limited to, polymers, rubbers, composites, and in a particular embodiment, can be an integrated circuit board constructed of a glass fiber epoxy composite. Advantageously, a sheet formed material allows the backing assembly of the invention to be reliably and consistently formed to high manufacturing tolerances. Conductive layer 12*a* is preferably copper, however, conductive layer 12*a* can be any conductive material.

Conductive layer 12*a* is applied to an outer facing major surface of first planar substrate 11 in accordance with standard printed board fabrication techniques. Conductive layer 12*a* is then etched so that electrical contact material, in the form of conductive traces 14*a* through 14*n*, are formed therein. Alternatively, electrical contact material can be applied to one or both major surfaces of first planar substrate 11 using other subtractive techniques such as laser scribing, and other additive techniques, such as plating, deposition, printing, etc. Furthermore, electrical contact material may be metal, as discussed below, or may be another electrically conductive material such as, but not limited to, graphite or conductive ink.

Illustratively, conductive traces 14*a* through 14*n* are formed by applying a mask over conductive layer 12*a*, the mask covering the portions of conductive layer 12*a* that will form conductive traces 14*a* through 14*n*. After applying the mask to conductive layer 12*a*, an etchant is introduced to the exposed portions of the conductive layer such that the exposed portions are etched away, leaving conductive traces 14*a* through 14*n* remaining. The mask may remain in place, or can be removed exposing conductive traces 14*a* through 14*n*. Although shown only on one surface, additional conductive traces can be exposed on the rear surface of backing assembly element 10 in a similar manner as shown in FIG. 1B. In this manner, backing assembly element 10 is formed of a single planar substrate and has electrical contact material applied thereto. This technique allows a precise alignment between conductors and allows a large number of conductors to be easily applied to. a single planar substrate 11.

Shown for illustration purposes, transducer assembly 21 includes individual transducer elements 21*a* through 21*n*. Each individual transducer element 21*a* is an ultrasonic transducer, which may be constructed of a PZT material, or alternatively, may be a micro-machined ultrasonic transducer (MUT) constructed in accordance with the above-mentioned U.S. Pat. No. 5,619,476 to Haller, et al.

In accordance with an aspect of the invention, electrical contact material, such as in the form of conductive traces 14*a* through 14*n*, can be applied to first planar substrate 11 in any configuration by using printed circuit board fabrication techniques. In this manner, conductive traces 14*a* through 14*n* can be precisely located and electrical contact material can be efficiently and effectively applied to first planar substrate 11. Each transducer element 21*a* through 21*n* electrically contacts a conductive trace 14*a* through 14*n*.

In accordance with another aspect of the invention, the thermal coefficient of expansion (TCE) difference between the electrical contact material (in this embodiment conductive traces 14*a* through 14*n*) and the first planar substrate 11 can be minimized. TCE mismatch causes materials having different TCE's to expand and contract at different rates when subjected to temperature extremes and temperature cycling. By closely matching the TCE of the material that forms the conductive traces 14*a* through 14*n* with the TCE of the material comprising the first planar substrate 11, mechanical stresses caused by temperature extremes and temperature cycling, which degrade and can break the electrical connection between the conductive traces 14*a* through 14*n* and the individual transducer elements 21*a* through 21*n* of transducer assembly 21, can be minimized.

For example, first planar substrate 11 illustratively comprises a mixture of glass fiber and epoxy. The glass fiber material has a TCE much lower than that of the conductive material, for example copper, that comprises the electrical contact material, while the epoxy component of first planar substrate 11 has a TCE that is significantly higher than that of the electrical contact material. By controlling the ratio of glass fiber and epoxy in first planar substrate 11, the TCE of first planar substrate 11 can be designed and fabricated to closely match the TCE of the electrical contact material (conductive traces 14*a* through 14*n*). In this manner, first planar substrate 11 and conductive traces 14*a* through 14*n* should expand and contract with temperature at a closely matched rate, thereby reducing the mechanical stresses on both components. This should significantly reduce instances of mechanical failure of the electrical connections between conductive traces 14*a* through 14*n* and ultrasonic transducer elements 21*a* through 21*n* of transducer assembly 21, respectively.

In accordance with another aspect of the invention, the first planar substrate 11 can be established to provide superior acoustic attenuation for acoustic energy that is directed toward backing assembly element 10 from transducer assembly 21. When each of the transducer elements 21*a* through 21*n* is excited with an electrical pulse, each element projects a pulse in both the direction indicated by arrow 12 and in the direction indicated by arrow 16. In other words, an individual transducer element 21*a* through 21*n* projects an acoustic pulse in directions additional to the desired direction (i.e., toward a target). The acoustic energy that is projected out of each element 21*a* through 21*n* toward backing assembly element 10 in the direction indicated by arrow 16 can be significantly attenuated by first planar substrate 11. In this regard, by carefully choosing the ratio of the glass fibers and the epoxy in first planar substrate 11, the acoustic impedance of the first planar substrate 11 can be tuned to a desired value. Additionally, by carefully selecting these materials (i.e., the epoxy and the glass fibers), first planar substrate 11 can have a high degree of acoustic attenuation. In this manner, the acoustic attenuation of first planar substrate 11 can be optimized for many transducer applications. For example, the glass fibers that are part of first planar substrate 11 may be in the form of particles, randomly oriented fibers, aligned fibers, honeycombs, etc.

FIG. 1B is a schematic view illustrating an alternative embodiment 20 of the backing assembly element of FIG. 1. As shown, backing assembly element 20 includes first planar substrate 11 to which is applied, conductive layers 12*a* and 12*b*. Conductive traces 14*a* through 14*n* are etched into conductive layers 12*a* and 12*b* as described above with respect to FIG. 1A. Transducer assembly 27 includes transducer elements 27*a* through 27*n*, which each connect to a conductive trace 14*a* through 14*n* as described above. Backing assembly element 20 illustrated. in FIG. 1B includes conductive layers 12*a* and 12*b* on both major surfaces of first planar substrate 11, which allows backing assembly element 20 to provide connections to twice the, number of transducer elements 27*a* through 27*n* than that shown in FIG. 1A.

FIG. 1C is a schematic view illustrating the first planar substrate 11 of FIGS. 1A and 1C. In accordance with the invention, first planar substrate 11 includes glass fibers 25 oriented as shown. For example, arrow 22 indicates the longitudinal major surface of first planar substrate 11. When oriented diagonally to the longitudinal major surface indicated by arrow 22, glass fibers 25 provide maximum acoustic attenuation. While shown at an angle of approximately 45° with respect to the longitudinal major surface of first planar substrate 11, glass fibers 25 may be oriented at other angles and still provide the desired acoustic attenuation properties. The glass fibers 25 in FIG. 1C are shown highly exaggerated for illustration purposes.

Figure 2:
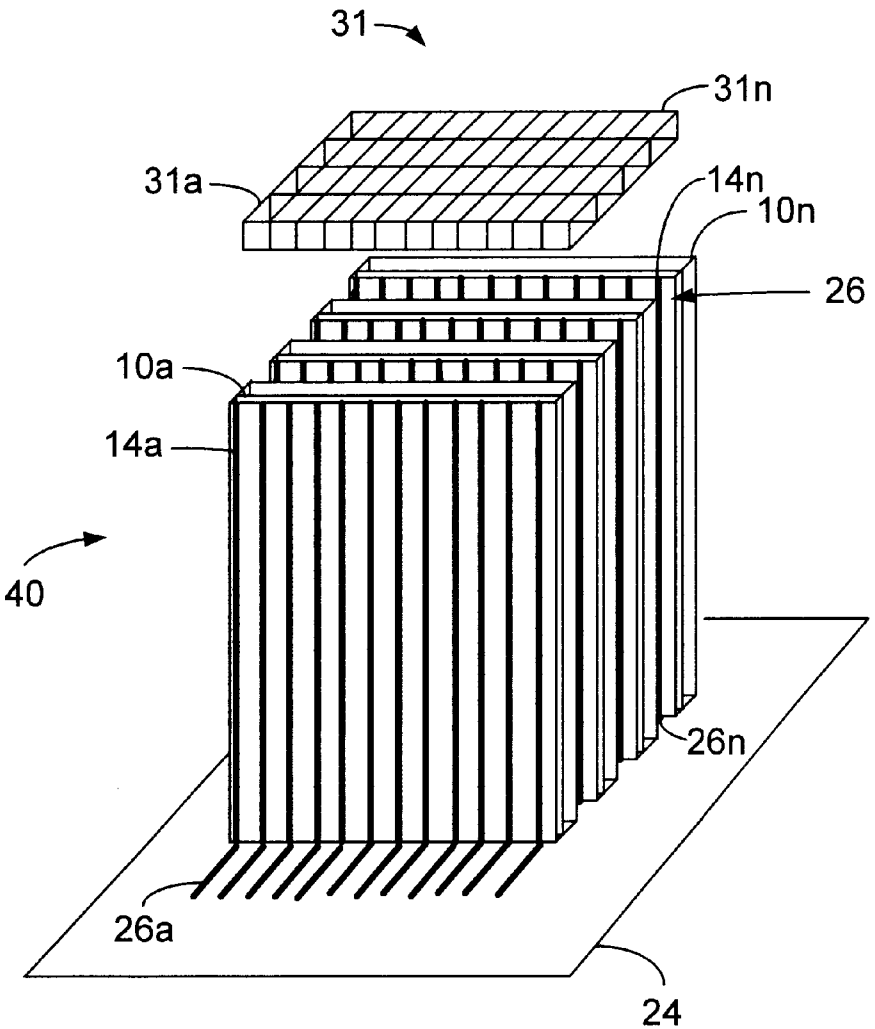
FIG. 2 is a schematic view illustrating a backing assembly including a plurality of backing assembly elements of FIG. 1A.

FIG. 2 is a schematic view illustrating a backing assembly 40 including a plurality of backing assembly elements 10*a* through 10*n* of FIG. 1A. In accordance with an aspect of the invention, backing assembly elements 10*a* through 10*n* can be applied to a circuit board 24 as shown. For example, backing assembly elements 10*a* through 10*n* may be bonded to the surface of circuit board 24 so as to align conductive traces 14*a* through 14*n* with conductive traces 26*a* through 26*n* of circuit board 24. The conductive traces 14*a* through 14*n* are electrically connected to the conductive traces 26*a* through 26*n*. Backing assembly elements 10 are stacked as shown to form a backing assembly 40 for a two-dimensional transducer array 31. Two-dimensional transducer array 31 includes transducer elements 31*a* through 31*n*, which are similar to transducer elements 21*a* through 21*n* of FIG. 1. Two-dimensional transducer array 31 is located over backing assembly 40 such that each conductive trace 14*a* through 14*n* on each backing assembly element 10 contacts the appropriate transducer element 31*a* through 31*n* of two-dimensional array 31. While shown for illustration purposes as separate from backing assembly 40, in practice transducer array 31 would be located in acoustic and electrical contact with backing assembly 40. In this manner, electrical signals applied through circuit board 24 through conductive traces 26*a* through 26*n* are connected to the appropriate transducer element 31*a* through 31*n*. For example, electrical contact 26*a* on circuit board 24 is electrically connected to conductive trace 14*a* of backing assembly element 10*a*. Conductive trace 14*a* electrically connects to transducer element 31*a* of array 31 thereby providing an electrical connection between conductive trace 26*a* of circuit board 24 and ultrasonic transducer element 31*a*.

When backing assembly elements 10*a* through 10*n* are assembled to circuit board 24 as shown in FIG. 2 a gap 26 is preferably allowed between each backing assembly element 10. The gap 26 will be described in further detail with respect to FIG. 4A.

Figure 3B:
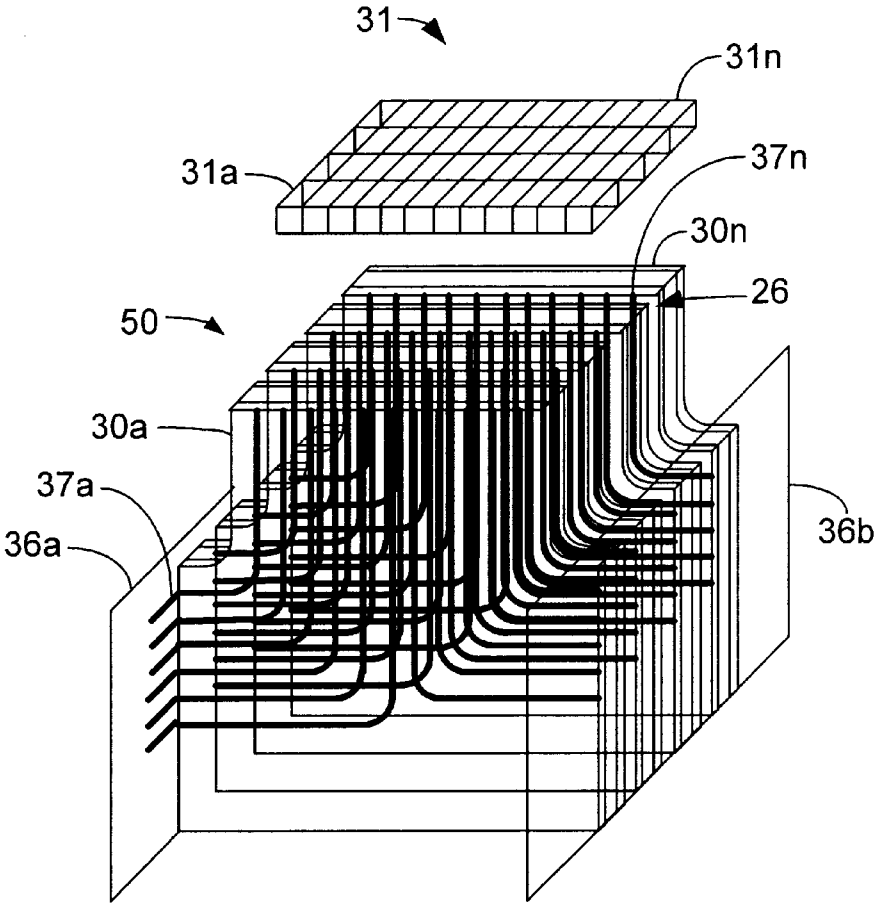
FIG. 3B is a schematic view illustrating a backing assembly including a plurality of backing assembly elements of FIG. 3A.
Figure 3A:
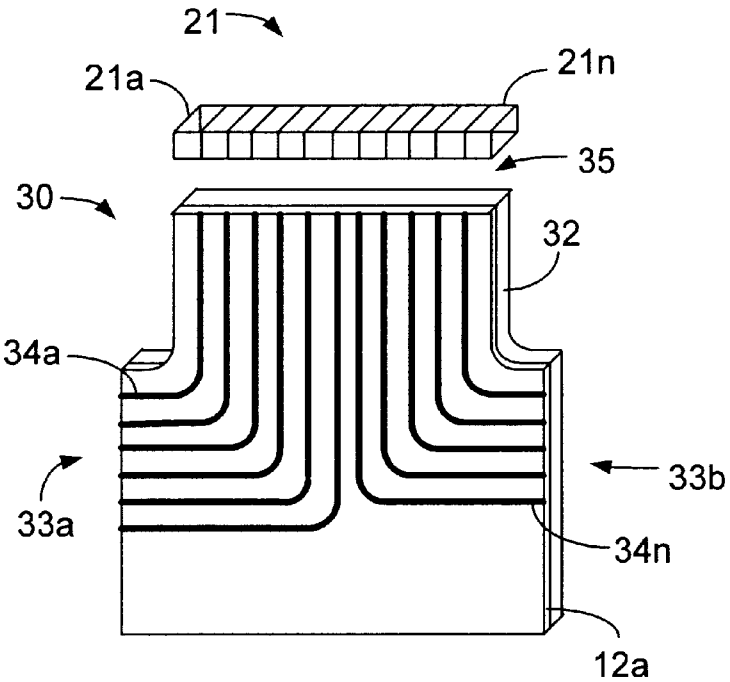
FIG. 3A is a schematic view of an alternative embodiment of the backing assembly element of FIG. 1A.

FIG. 3A is a schematic view of an alternative embodiment 30 of the backing assembly element 10 of FIG. 1A. In the embodiment shown in FIG. 3A, backing assembly element 30 includes planar substrate 32 to which is applied conductive layer 12*a*. In a departure from that described with respect to FIG. 1A, conductive traces 34*a* through 34*n* are formed in conductive layer 12*a* such that the conductive traces 34*a* through 34*n* electrically connect surfaces 33*a* and 33*b* of backing assembly element 30 to the surface 35 of backing assembly element 30, which is the surface at which ultrasonic transducer array 21 is located. In the embodiment shown in FIG. 3A, surfaces 33*a* and 33*b* are orthogonal to surface 35. In this manner, connection of a transducer array to a surface orthogonal thereto is possible. This will be illustrated in further detail in FIG. 3B. Although shown as having a 90° bend, conductive traces 34*a* through 34*n* can be constructed in any manner in which a conductive trace can be etched into conductive layer 12*a*, and into a conductive layer located on the surface of planar substrate 32 opposite that which conductive layer 12*a* is located.

FIG. 3B is a schematic view illustrating a backing assembly 50 including a plurality of backing assembly elements 30*a* through 30*n* of FIG. 3A. In a similar manner to that described with respect to FIG. 2, backing assembly elements 30*a* through 30*n* are stacked in a manner which supports a two-dimensional transducer array 31. In the embodiment shown in FIG. 3B, circuit boards 36*a* and 36*b* are applied to backing assembly elements 30*a* through 30*n* in a plane orthogonal to the plane in which two-dimensional transducer array 31 is located. In this manner, electrical contact can be achieved between the appropriate circuit board traces 37*a* through 37*n* and individual elements 31*a* through 31*n* of two-dimensional transducer array 31. The backing assembly 50 constructed in accordance with the invention provides significant acoustic attenuation, while also precisely locating the electrical contact material such that elements 31*a* through 31*n* of transducer array 31 can be connected to the appropriate conductive traces 37*a* through 37*n* of circuit boards 36*a* and 36*b*, respectively. Furthermore, the ability to closely match the TCE of the planar substrates 11 and 32 to the TCE of the conductive traces 14*a* through 14*n*, and 34*a* through 34*n* ensures that the electrical connections between transducer elements and their respective circuit board traces should suffer less fatigue when subjected to temperature extremes and temperature cycling.

Figure 4A:
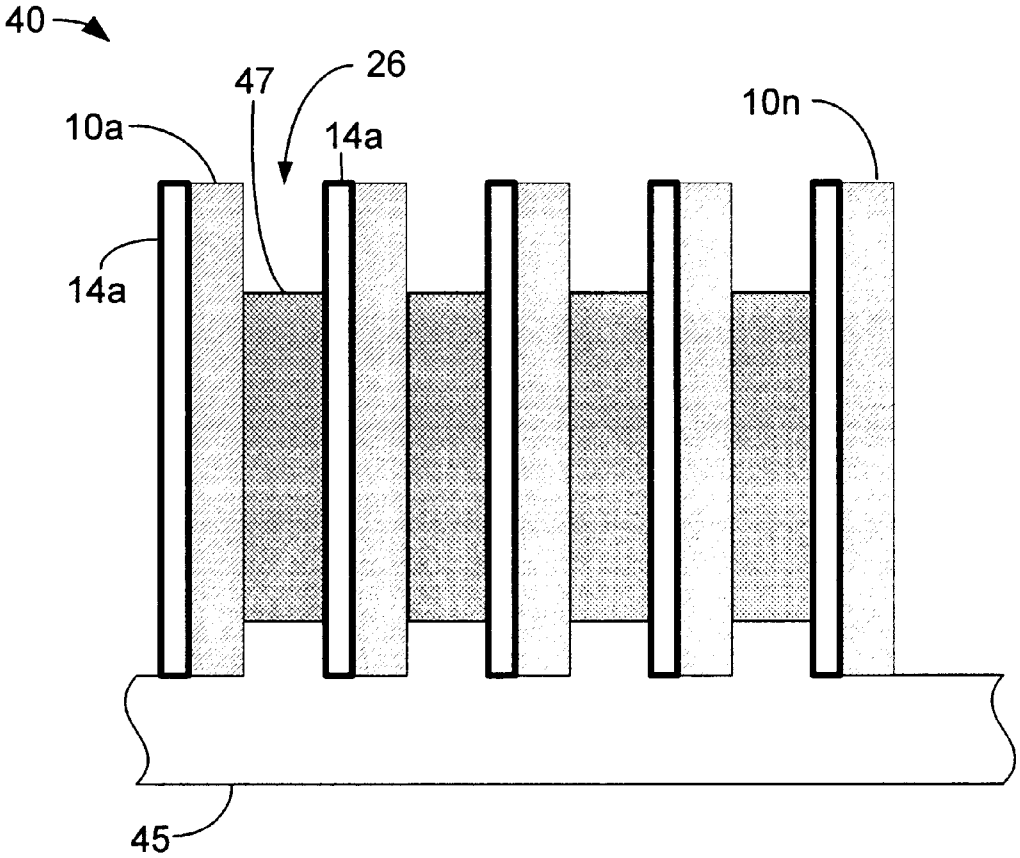
FIG. 4A is a cross-sectional view illustrating an assembly technique used when fabricating the backing assembly of FIG. 2.

FIG. 4A is a cross-sectional view illustrating an assembly technique used when fabricating the backing assembly 40 of FIG. 2. Individual backing assembly elements 10*a* through 10*n* are stacked in fixture 45 as shown leaving a gap 26 between each backing assembly element 10*a* through 10*n*. An epoxy material 47, that when cured exhibits properties similar to those of first planar substrate 11 (FIG. 1C), is applied into gap 26, such that appropriate spacing and structural integrity is maintained between backing assembly elements 10*a* through 10*n*. For example, a liquid epoxy material 47 can be applied into gap 26. When cured, the liquid epoxy material 47 bonds the backing assembly elements 10*a* through 10*n* into a backing assembly 40, which can be used as shown in FIG. 2. Alternatively, the material used to fill gap 26 can be a urethane, or other liquid bonding material that when cured forms a suitable bond with backing assembly elements 10*a* through 10*n*.

Figure 4B:
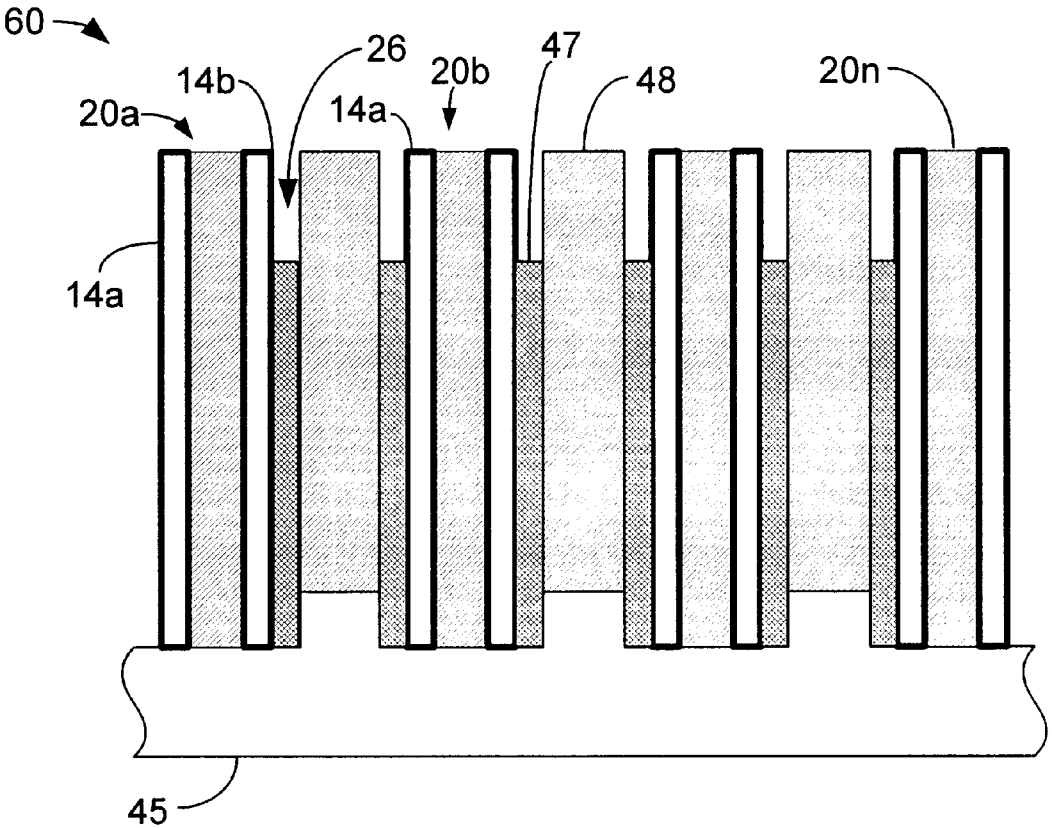
FIG. 4B is a cross-sectional view illustrating the assembly technique used when fabricating backing assembly elements of FIG. 1B into a backing assembly.

FIG. 4B is a cross-sectional view illustrating the assembly technique used when fabricating backing assembly elements 20 of FIG. 1B into a backing assembly 60. When a double sided planar substrate, such as backing assembly element 20, which includes electrical contact material on both major surfaces, forms the backing assembly, a second planar substrate 48, similar in mechanical and acoustic properties to first planar substrate 11 and 32, is used between individual backing assembly elements 20*a*–20*n*. Second planar substrate 48 provides electrical isolation between electrical contact material on two adjoining backing assembly elements. For example, conductive trace 14*b* on one surface of backing assembly element 20*a* should be electrically isolated from conductive trace 14*a* of backing assembly element 20*b*.

Furthermore, the material from which the second planar substrate 48 is fabricated exhibits acoustic properties similar to those exhibited by first planar substrates 11 and 32. Second planar substrate 48 can be a glass fiber epoxy composite, similar in composition to the glass fiber epoxy composite that comprises first planar substrate 11. Epoxy material 47 is applied into gap 46 between each backing assembly element 20 and each second planar substrate 48 in similar manner to that described above with respect to FIG. 4A.

Alternatively, a wire frame carrier that includes electrical contact material can be constructed and placed in a fixture, similar to fixture 45, between sheets of second planar substrate 48 leaving gaps 46 between the wire frame and the sheets of second planar substrate. An epoxy material 47 can be applied in the gap, resulting in a structure similar to that described with respect to FIG. 4B. However, the electrical contact material will be sandwiched between layers of epoxy material 47, which are sandwiched between layers of second planar substrate 48.

Figure 5:
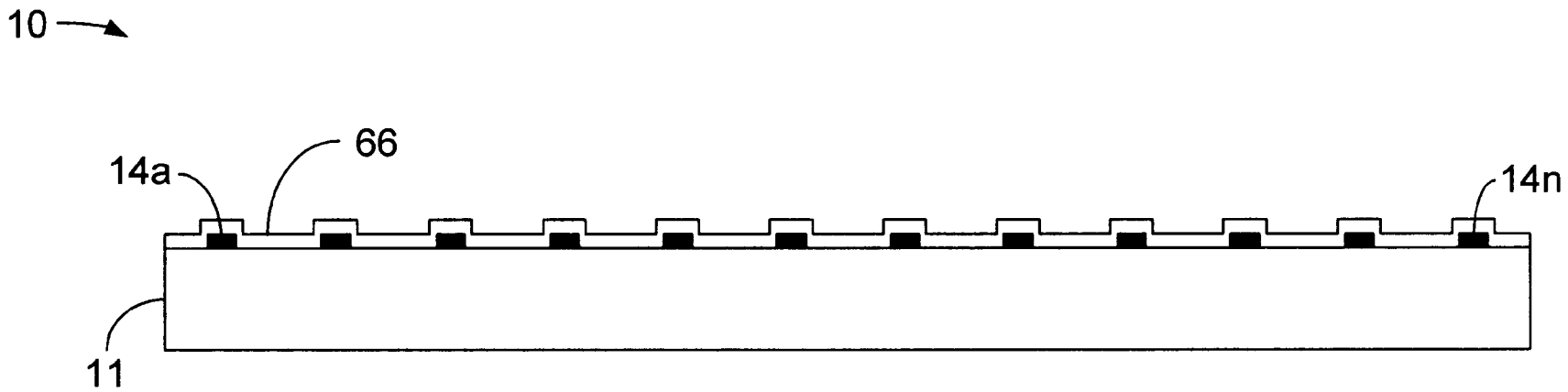
FIG. 5 is a plan view illustrating the backing assembly element of FIG. 1A.

FIG. 5 is a plan view illustrating the backing assembly element 10 of FIG. 1A. In accordance with another aspect of the invention, an electrical insulating material 66 is applied over conductive traces 14*a* through 14*n* and the surface of first planar substrate 11 that includes conductive traces 14*a* through 14*n*. In this manner, additional electrical isolation is provided to the electrical contact material when assembled into a backing assembly as illustrated with respect to FIG. 4A.

Figure 6:
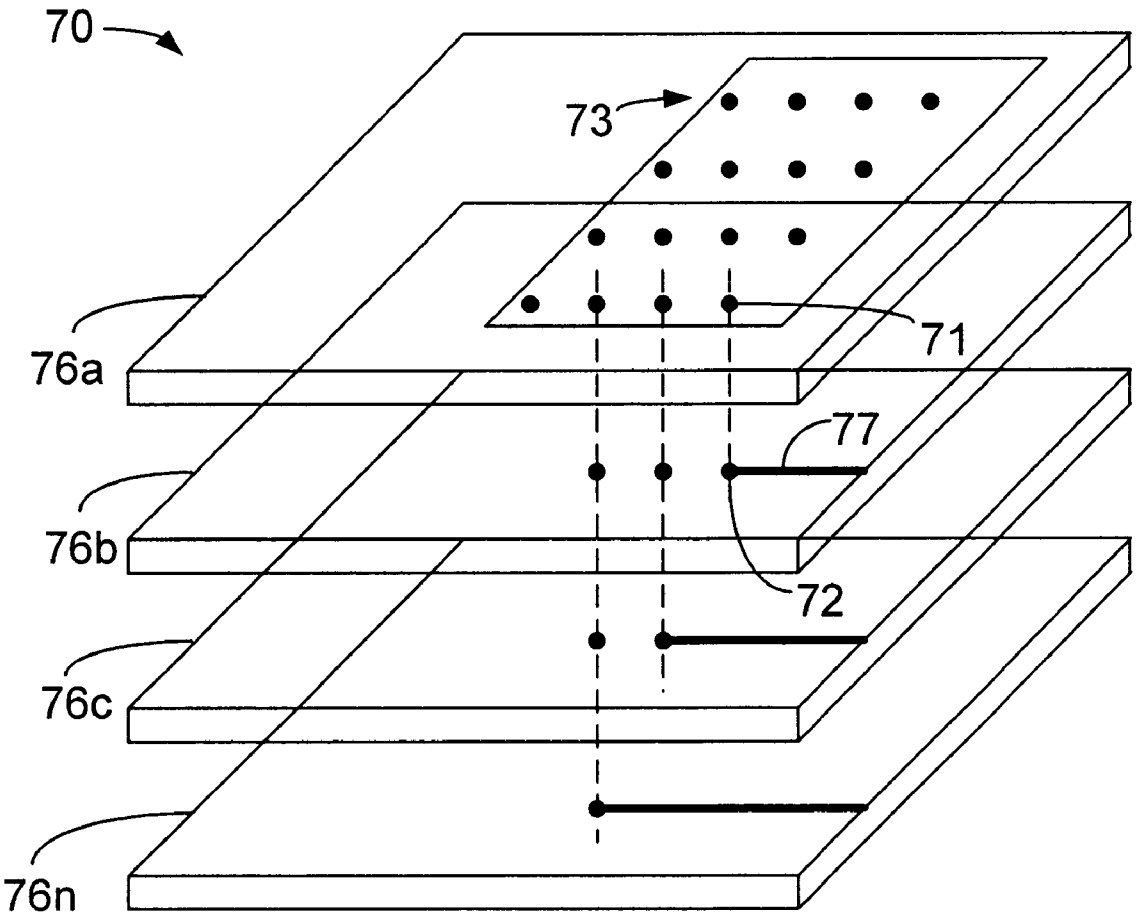
FIG. 6 is a schematic view illustrating a backing assembly using an alternative embodiment of the backing assembly element of FIG. 1.

FIG. 6 is a schematic view illustrating a backing assembly 70 using an alternative embodiment of the backing assembly element 10 of FIG. 1. Backing assembly 70 includes backing assembly elements 76*a* through 76*n*. Backing assembly elements 76*a* through 76*n* are structured to include through connections between elements 76*a* through 76*n*. For example, backing assembly element 76*a* includes a matrix 73 of through connections. Through connection matrix 73 includes a plurality of through holes, an exemplary one of which is illustrated using reference numeral 71. Through hole 71 of backing assembly element 76*a* and through hole 72 of backing assembly element 76*b* provide an electrical connection between backing assembly element 76*a* and 76*b*. Through hole 72 located on backing assembly element 76*b* is in electrical communication with electrical conductor 77. In this manner, a transducer element (not shown) electrically connected to conductor 77 can also be electrically connected to through hole 71.

Figure 7:
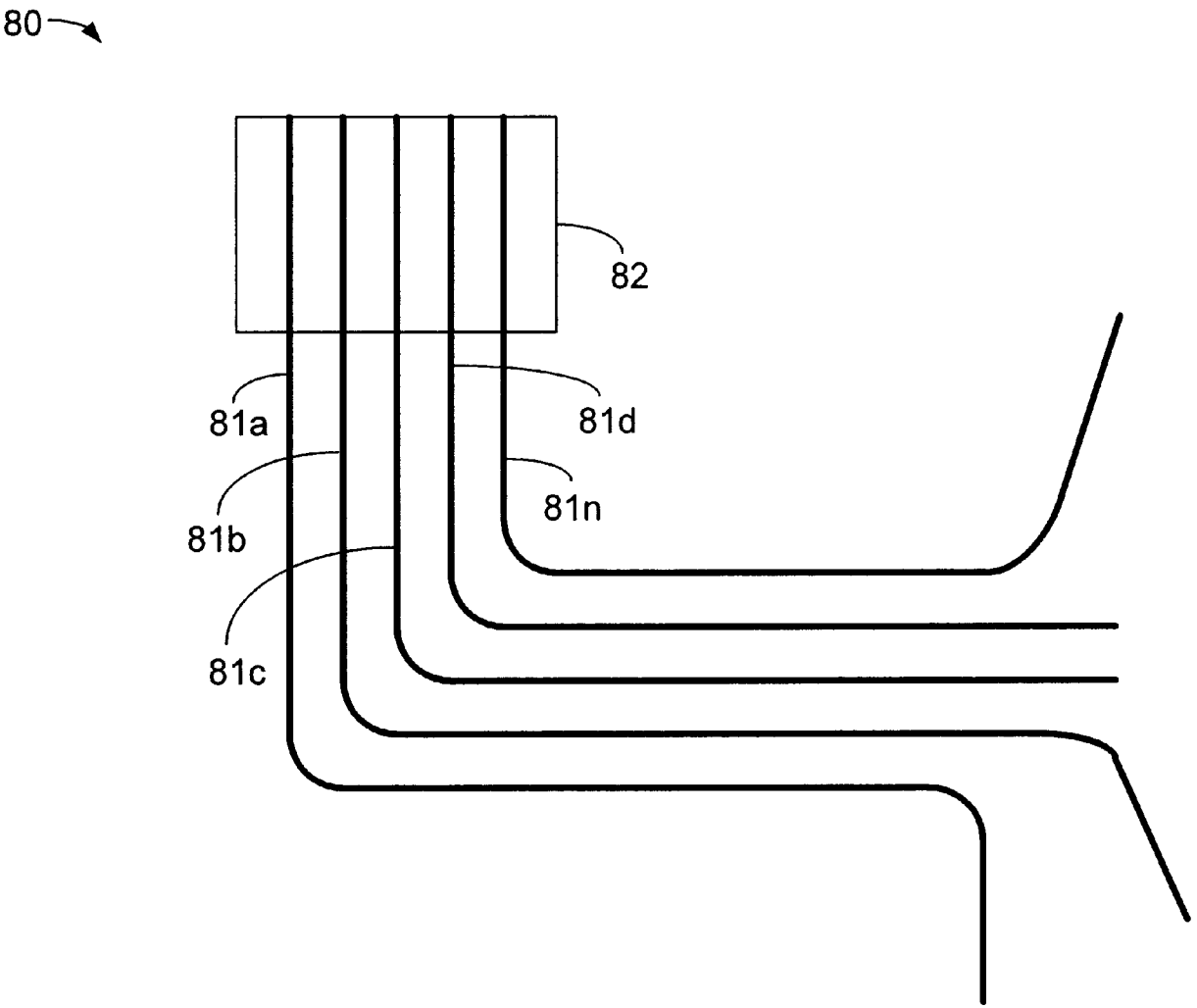
FIG. 7 is a schematic view illustrating an alternative embodiment of the backing assembly using an alternative embodiment of the backing assembly element of FIG. 1.

FIG. 7 is a schematic view illustrating an alternative embodiment 80 of the backing assembly using an alternative embodiment 81 of the backing assembly element of FIG. 1. Backing assembly 80 includes backing assembly elements 81*a* through 81*n*, which are formed using a flexible sheet material to which electrically conductive material is applied. A first end of each backing assembly element 81*a* through 81*n* is laminated into a rigid structure 82 using either epoxy material 47 alone (FIG. 4A) or a combination of epoxy material 47 and second planar substrate 48 (FIG. 4B), depending on whether the backing assembly elements 81*a* through 81*n* include electrical contact material on one or more surfaces.

Figure 8:
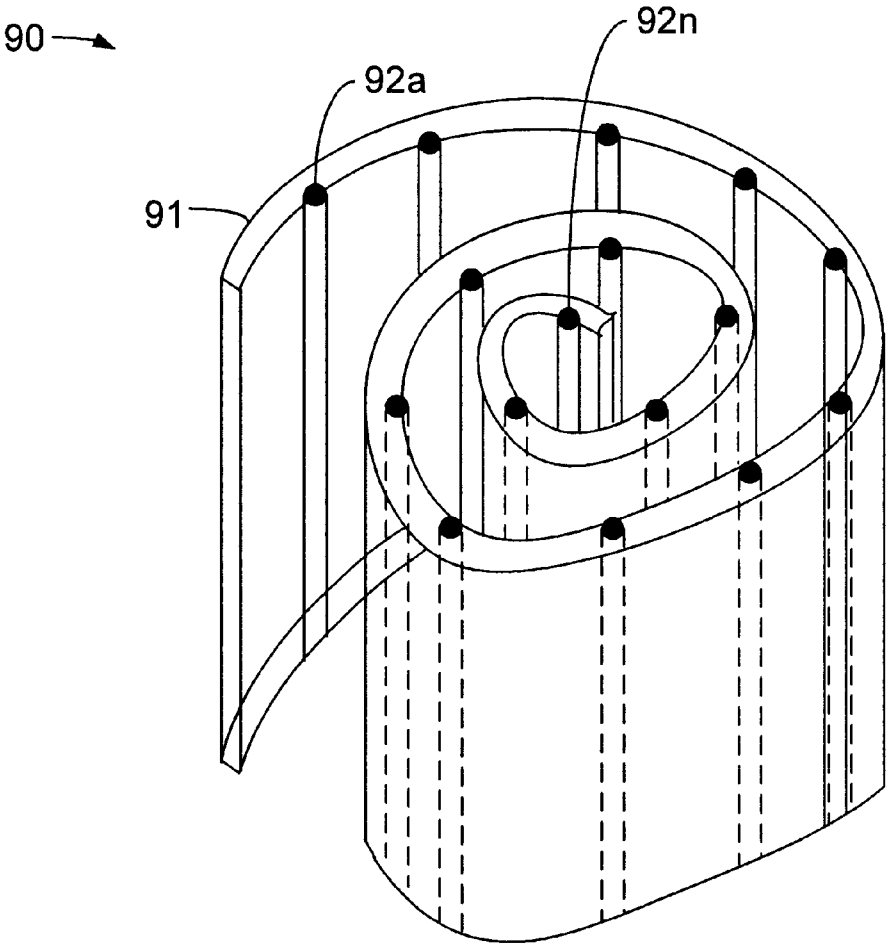
FIG. 8 is a schematic view illustrating another alternative embodiment of the backing assembly using yet another alternative embodiment of the backing assembly element of FIG. 1.

FIG. 8 is a schematic view illustrating another alternative embodiment 90 of the backing assembly using yet another alternative embodiment 91 of the backing assembly element of FIG. 1. Backing assembly 90 includes backing assembly element 91, which is a flexible sheet material similar to that described above with respect to FIG. 7. Backing assembly element 91 includes electrical contacts 92*a* through 92*n*. As shown, backing assembly element 91 is formed into a coil such that electrical contacts 92*a* through 92*n* are axially aligned. In this manner, electrical contacts 92*a* through 92*n* provide electrical connection between transducer (not shown) elements and electrical excitation circuitry (not shown) in similar manner to that described above with respect to FIG. 2.

Figure 9B:
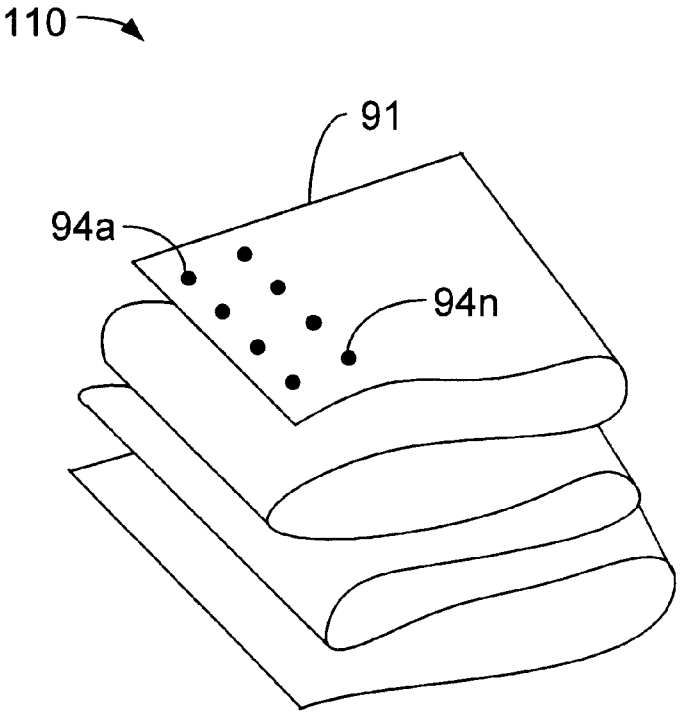
FIG. 9B is a schematic view illustrating still another alternative embodiment of the backing assembly using the backing assembly element of FIG. 8.
Figure 9A:
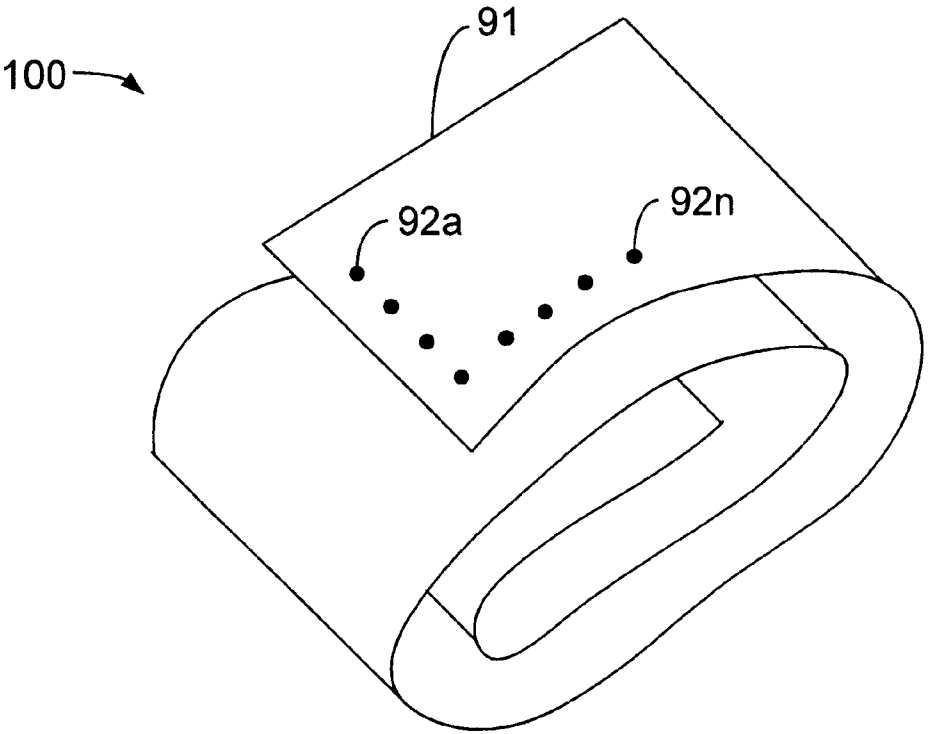
FIG. 9A is a schematic view illustrating yet another alternative embodiment of the backing assembly using the backing assembly element of FIG. 8.

FIG. 9A is a schematic view illustrating yet another alternative embodiment 100 of the backing assembly using the backing assembly element 91 of FIG. 8. As shown in FIG. 9A, backing assembly 100 includes backing assembly element 91 rolled into a coil, similar to that described in FIG. 8. However, electrical contacts 92*a* through 92*n* included in backing assembly 100 are similar to that described with respect to FIG. 6. For simplicity, only a portion of the electrical contacts that may be included in backing assembly 100 are illustrated in FIG. 9A.

FIG. 9B is a schematic view illustrating still another alternative embodiment 110 of the backing assembly using the backing assembly element 91 of FIG. 8. As shown in FIG. 9B, backing assembly 110 includes backing assembly element 91 folded into a "Z" shape. Backing assembly 110 includes electrical contacts 94*a* through 94*n* similar to that described with respect to FIG. 9A. For simplicity, only a portion of the electrical contacts that may be included in backing assembly 110 are illustrated in FIG. 9B. Alternatively, backing assembly element 91 may be configured into other shapes, such as alternately folding portions of the element to form a double Z configuration.

It will be apparent to those skilled in the art that many modifications and variations. may be made to the preferred embodiments of the present invention, as set forth above, without departing substantially from the principles of the present invention. For example, the present invention can be used to provide backing and acoustic absorption for a variety of transducer elements. All such modifications and variations are intended to be included herein within the scope of the present invention, as defined in the claims that follow.

What is claimed is:

1. A backing for an ultrasonic transducer array, comprising:

a first planar substrate including a first surface, said first planar substrate configured to acoustically couple to said ultrasonic transducer array, where said first surface is configured and dimensioned for positioning said ultrasonic transducer array above said first surface prior to said first planar substrate being acoustically coupled to said ultrasonic transducer array; and a plurality of conductive traces provided to said first surface of said first planar substrate, each of said plurality of conductive traces configured to electrically couple to at least a respective one of a plurality of transducers of said ultrasonic transducer array.

2. The backing of claim 1, wherein said first planar substrate is layered with alternating layers of an epoxy material to form a laminate.

3. The backing of claim 2, wherein said first planar substrate provides an attenuation of at least 10 dB/cm at 5 MHz.

4. The backing of claim 1, wherein said plurality of conductive traces are formed by etching an electrical contact material which is applied to said first planar substrate.

5. The backing of claim 4, wherein said electrical contact material is applied to said first planar substrate by a process chosen from the group consisting of plating, deposition, printing, and laser scribing.

6. The backing of claim 4, wherein said electrical contact material is chosen from the group consisting of metal, graphite, and conductive ink.

7. The backing of claim 1, wherein said first planar substrate has a thermal coefficient of expansion (TCE) substantially equal to the TCE of said electrical contact material.

8. The backing of claim 1, wherein said first planar substrate comprises a glass fiber composite, said glass fiber composite having a longitudinal major surface.

9. The backing of claim 8, wherein said glass fiber composite includes glass fibers oriented substantially diagonal to said longitudinal major surface.

10. The backing of claim 1, wherein said first planar substrate comprises a material chosen from the group consisting of polymers, rubbers, and composites.

11. The backing of claim 1, wherein said first planar substrate further comprises a second surface, said second surface including a plurality of conductive traces formed by applying an electrical contact material to said second surface.

12. The backing of claim 11, wherein said first and second planar substrates are layered with alternating layers of an epoxy material to form a laminate.

13. The backing of claim 12, wherein said second planar substrate comprises a glass fiber composite.

14. The backing of claim 13, wherein said second planar substrate comprises a material chosen from the group consisting of polymers, rubbers, and composites.

15. The backing of claim 1, wherein said first planar substrate is an acoustic absorber.

16. The backing of claim 1, wherein said plurality of conductive traces are covered with an electrical insulating material.

17. The backing of claim 1, wherein said first planar substrate is a flexible sheet material.

18. A method for making a backing for an ultrasonic transduce array, the method comprising the steps of:

forming a first planar substrate to include a first surface and configured to acoustically couple to said ultrasonic transducer array, where said first surface is configured and dimensioned for positioning said ultrasonic transducer array above said first surface prior to said first planar substrate being acoustically coupled to said ultrasonic transducer array; and providing a plurality of conductive traces to said first surface, each of said plurality of conductive traces configured to electrically couple to at least a respective one of a plurality of transducers of said ultrasonic transducer array.

19. The method of claim 18, further comprising the step of layering said first planar substrate with alternating layers of an epoxy material to form a laminate.

20. The method of claim 19, wherein said first planar substrate is formed to provide an attenuation of at least 10 dB/cm at 5 MHz.

21. The method of claim 18, wherein said plurality of conductive traces are formed by etching an electrical contact material which is applied to said first planar substrate.

22. The method of claim 21, wherein said electrical contact material is applied to said first planar substrate by a process chosen from the group consisting of plating, deposition, printing, and laser scribing.

23. The method of claim 21, wherein said electrical contact material is chosen from the group consisting of metal, graphite, and conductive ink.

24. The method of claim 18, wherein said first planar substrate is formed to have a thermal coefficient of expansion (TCE) substantially equal to the TCE of said electrical contact material.

25. The method of claim 18, wherein said first planar substrate is formed of a glass fiber composite, said glass fiber composite including glass fibers and having a longitudinal major surface.

26. The method of claim 25, wherein said first planar substrate is formed so that said glass fibers oriented substantially diagonal to said longitudinal major surface.

27. The method of claim 18, wherein said first planar substrate is formed of a material chosen from the group consisting of polymers, rubbers, and composites.

28. The method of claim 18, further comprising the steps of:

forming said first planar substrate to include a second major surface; and providing a plurality of conductive traces to said second major surface.

29. The method of claim 28, further comprising the step of layering said first and second planar substrates with alternating layers of an epoxy material to form a laminate.

30. The method of claim 29, wherein said second planar substrate is formed of a glass fiber composite.

31. The method of claim 30, wherein said second planar substrate is formed of a material chosen from the group consisting of polymers, rubbers, and composites.

32. The method of claim 18, wherein said first planar substrate is an acoustic absorber.

33. The method of claim 18, further comprising the step of applying an electrical insulating material over said plurality of conductive traces.

34. The method of claim 18, further comprising the step of forming said first planar substrate as a flexible sheet.

35. A method for making a backing for an ultrasonic transducer array, the method comprising the steps of:

providing a first planar substrate having a first surface, said first surface having a plurality of conductive traces;

acoustically coupling said first planar substrate to the ultrasonic transducer array, where said first surface is configured and dimensioned for positioning said ultrasonic transducer array above said first surface prior to said first planar substrate being acoustically coupled to said ultrasonic transducer array; and electrically coupling said plurality of conductive traces to the ultrasonic transducer array such that at least a respective one of a plurality of conductive traces couples with one of the plurality of transducers.

* * * * *